US010723130B2

(12) United States Patent
Kuroda et al.

(10) Patent No.: US 10,723,130 B2
(45) Date of Patent: Jul. 28, 2020

(54) LIQUID DISCHARGE HEAD, LIQUID DISCHARGE DEVICE, AND LIQUID DISCHARGE APPARATUS

(71) Applicants: Takahiko Kuroda, Hyogo (JP); Satoshi Mizukami, Kanagawa (JP)

(72) Inventors: Takahiko Kuroda, Hyogo (JP); Satoshi Mizukami, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/212,933

(22) Filed: Dec. 7, 2018

(65) Prior Publication Data

US 2019/0176469 A1 Jun. 13, 2019

(30) Foreign Application Priority Data

Dec. 7, 2017 (JP) ..... 2017-235431

(51) Int. Cl.
*B41J 2/14* (2006.01)
*B41J 2/16* (2006.01)

(52) U.S. Cl.
CPC ..... *B41J 2/1433* (2013.01); *B41J 2/161* (2013.01); *B41J 2/162* (2013.01); *B41J 2/1606* (2013.01); *B41J 2/1623* (2013.01); *B41J 2/1642* (2013.01)

(58) Field of Classification Search
CPC ..... B41J 2/1433; B41J 2/1606; B41J 2/161; B41J 2/162; B41J 2/1623; B41J 2/1642
See application file for complete search history.

(56) References Cited

U.S. PATENT DOCUMENTS

2004/0174411 A1* 9/2004 Sumiya ..... B41J 2/1433 347/47
2006/0232638 A1 10/2006 Kuroda et al.
2007/0057999 A1 3/2007 Kuroda
2013/0082028 A1* 4/2013 Dokyi ..... B41J 2/1603 216/27
2013/0250007 A1 9/2013 Ishimori et al.
2013/0250009 A1 9/2013 Ishimori et al.
2014/0267497 A1 9/2014 Takagi et al.
2014/0267506 A1 9/2014 Ohnishi et al.
2014/0375725 A1 12/2014 Sameshima et al.
2015/0171307 A1 6/2015 Masuda et al.

FOREIGN PATENT DOCUMENTS

JP 2004-098310 4/2004
JP 2012-009138 1/2012
JP 2014-198460 10/2014

* cited by examiner

*Primary Examiner* — Jason S Uhlenhake
(74) *Attorney, Agent, or Firm* — Oblon, McClelland, Maier & Neustadt, L.L.P.

(57) ABSTRACT

A liquid discharge head includes a head substrate and a surface treatment film on a surface of the head substrate. The surface treatment film is an oxide film containing Si. The oxide film contains a transition metal to form a passive film. A content of Si in a vicinity of an interface of the surface treatment film with the head substrate is higher than a content of Si in an inside of the surface treatment film and is 20 at % or more.

20 Claims, 13 Drawing Sheets

FIG. 8

| $SiO_2$ | CONTAINED ELEMENT at%(=mol%) | | | ADHESION STRENGTH |
|---|---|---|---|---|
| OCCUPIED AREA RATIO | Si | Ta | O | arb. |
| 0 | 0.0 | 28.6 | 71.4 | 10 |
| 10 | 2.4 | 26.5 | 71.1 | 13 |
| 20 | 4.9 | 24.3 | 70.7 | 18 |
| 30 | 7.6 | 22.0 | 70.3 | 20 |
| 40 | 10.5 | 19.5 | 69.9 | 25 |
| 50 | 13.7 | 16.9 | 69.5 | 30 |
| 60 | 17.0 | 14.0 | 69.0 | 40 |
| 70 | 20.6 | 10.9 | 68.5 | 80 |
| 80 | 24.5 | 7.6 | 67.9 | 90 |
| 90 | 28.7 | 3.9 | 67.3 | 91 |
| 100 | 33.3 | 0.0 | 66.7 | 91 |

LIQUID DISCHARGE HEAD, LIQUID DISCHARGE DEVICE, AND LIQUID DISCHARGE APPARATUS

CROSS-REFERENCE TO RELATED APPLICATION

This patent application is based on and claims priority pursuant to 35 U.S.C. § 119(a) to Japanese Patent Application No. 2017-235431, filed on Dec. 7, 2017, in the Japan Patent Office, the entire disclosure of which is incorporated by reference herein.

BACKGROUND

Technical Field

The present disclosure relates to a liquid discharge head, a liquid discharge device, and a liquid discharge apparatus.

Description of the Related Art

In a liquid discharge head, a surface treatment film is formed on a wall surface (surface) of a head substrate such as a channel formation member that forms a channel of liquid to improve liquid resistance.

SUMMARY

In an aspect of the present disclosure, there is provided a liquid discharge head that includes a head substrate and a surface treatment film on a surface of the head substrate. The surface treatment film is an oxide film containing Si. The oxide film contains a transition metal to form a passive film. A content of Si in a vicinity of an interface of the surface treatment film with the head substrate is higher than a content of Si in an inside of the surface treatment film and is 20 at % or more.

In another aspect of the present disclosure, there is provided a liquid discharge device that includes the liquid discharge head.

In still another aspect of the present disclosure, there is provided a liquid discharge apparatus that includes the liquid discharge device.

In still yet another aspect of the present disclosure, there is provided a liquid discharge apparatus that includes the liquid discharge head.

BRIEF DESCRIPTION OF THE DRAWINGS

The aforementioned and other aspects, features, and advantages of the present disclosure would be better understood by reference to the following detailed description when considered in connection with the accompanying drawings, wherein:

FIG. 8 is a chart illustrating numerical values of an example of the relationship between an occupied area ratio of a $SiO_2$ film and the adhesion (adhesion strength) at an interface between the surface treatment film and a head substrate;

Figure 1:
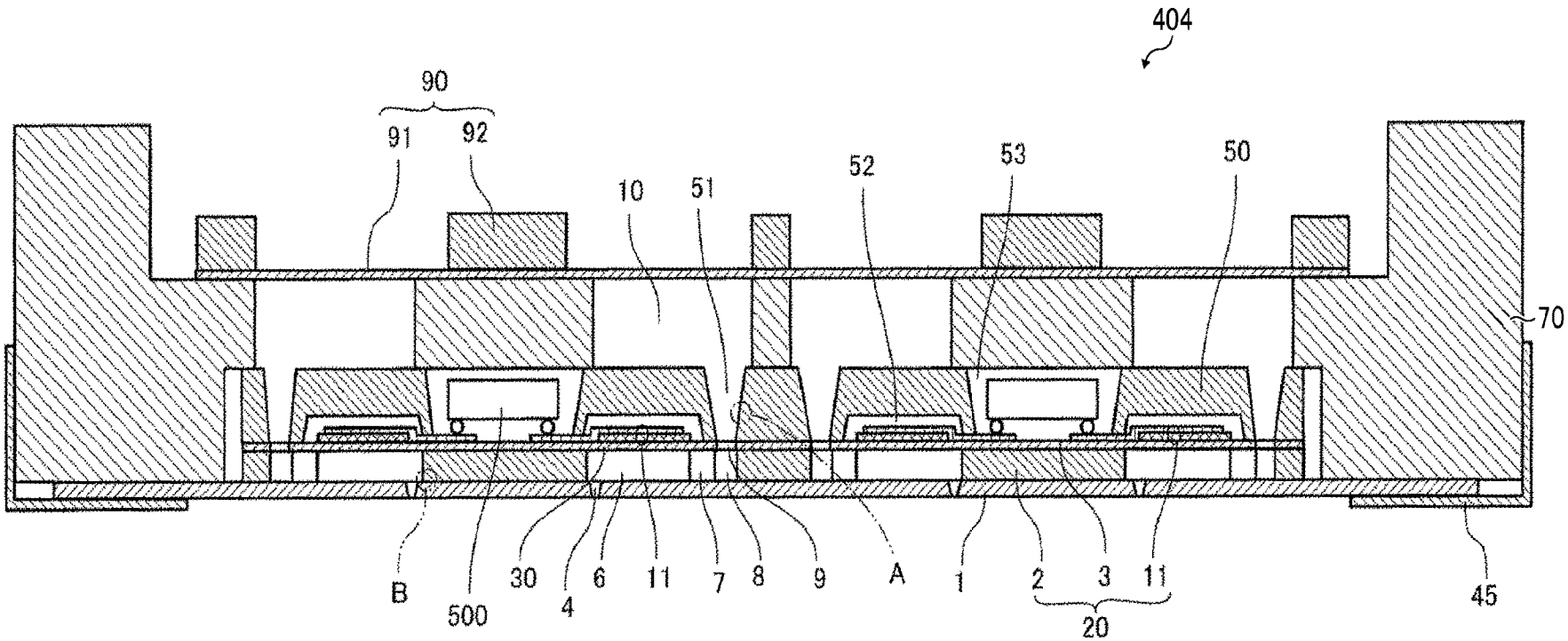
FIG. 1 is a cross-sectional explanatory view along a direction orthogonal to a nozzle array direction of a first embodiment of a liquid discharge head according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Figure 2:
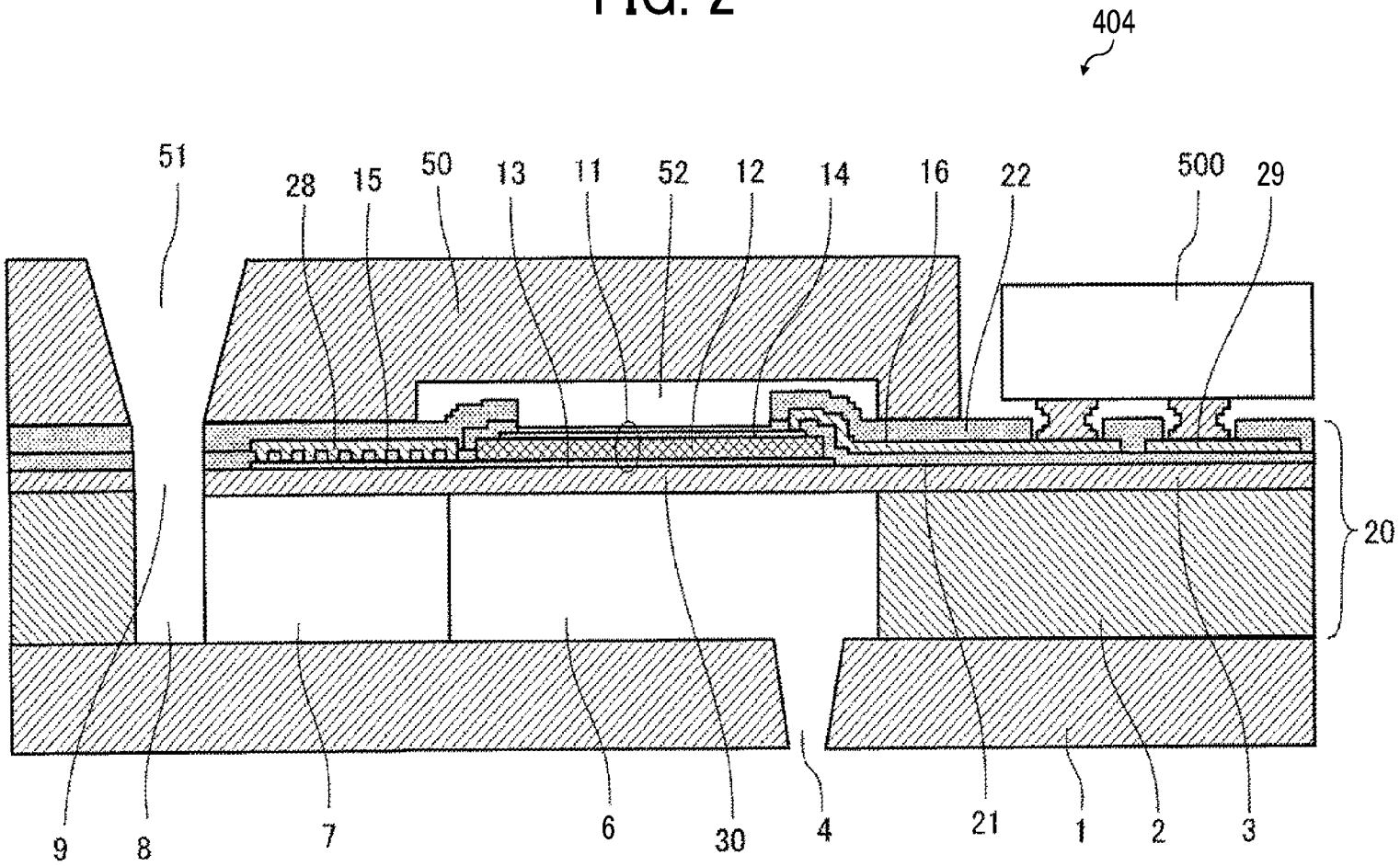
FIG. 2 is an enlarged cross-sectional explanatory view of a main portion of FIG. 1.
Figure 3:
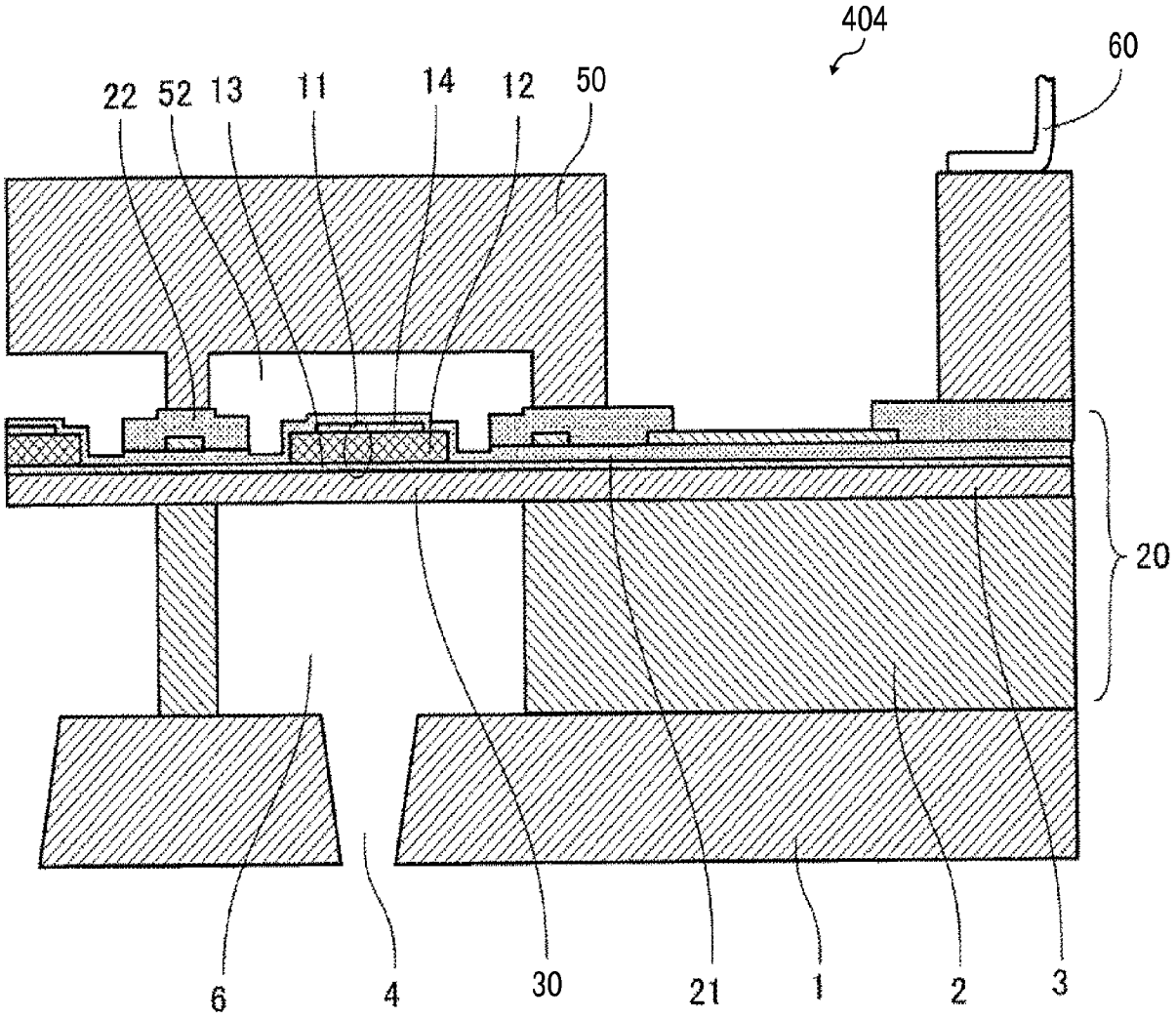
FIG. 3 is a cross-sectional explanatory view of a main portion along the head nozzle array direction.

Embodiments of the present disclosure will be described below with reference to the accompanying drawings. A liquid discharge head according to a first embodiment of the present disclosure will be described with reference to FIGS. 1 to 3. FIG. 1 is a cross-sectional explanatory view along a direction orthogonal to a nozzle array direction of the head, FIG. 2 is an enlarged cross-sectional explanatory view of a main portion of FIG. 1, and FIG. 3 is a cross-sectional explanatory view of a main portion along the head nozzle array direction.

A liquid discharge head 404 includes a nozzle plate 1, a channel plate 2, a diaphragm member 3 as a wall member, a piezoelectric element 11 as a pressure generating element, a holding substrate 50, a wiring member 60 such as a flexible printed circuit (FPC), a common chamber member 70, and a cover member 45.

Here, a portion including the channel plate 2, the diaphragm member 3 and the piezoelectric element 11 is an actuator substrate 20.

The nozzle plate 1 has a plurality of nozzles 4 that discharges liquid. Here, four nozzle rows in which the nozzles 4 are arrayed are arranged.

The channel plate 2 forms together with the nozzle plate 1 and the diaphragm member 3: an individual liquid chamber 6 with which the nozzle 4 communicates; a fluid resistance 7 that communicates with the individual liquid chamber 6; and a liquid introduction 8 with which the fluid resistance 7 communicates.

The liquid introduction 8 communicates with a common chamber 10 formed by the common chamber member 70 via an opening 9 of the diaphragm member 3 and an opening 51 as a channel of the holding substrate 50.

The diaphragm member 3 forms a deformable vibration region 30 that forms a part of a wall surface of the individual liquid chamber 6. The diaphragm member 3 has a piezoelectric element 11 provided integrally with the vibration region 30, on a surface of the vibration region 30 opposite to the individual liquid chamber 6, and the vibration region 30 and the piezoelectric element 11 forms a piezoelectric actuator.

The piezoelectric element 11 is formed by sequentially stacking a lower electrode 13, a piezoelectric layer (piezoelectric material) 12, and an upper electrode 14 from the vibration region 30 side. The piezoelectric element 11 has an insulating film 21 thereon.

The lower electrode 13 as a common electrode of a plurality of the piezoelectric element 11 is coupled to a common electrode power supply wiring pattern 28 via a common wiring 15. The lower electrode 13 is one electrode layer formed across all the piezoelectric elements 11 in a nozzle array direction.

The upper electrode 14 as an individual electrode of the piezoelectric elements 11 is coupled to a driving IC (hereinafter referred to as a "driver IC") 500 as a driving circuit, via an individual wiring 16. The individual wiring 16 and the like are covered with an insulating film 22.

The actuator substrate 20 has the driver IC 500 mounted thereon by a method such as flip chip bonding so that the driver IC 500 covers a region between the rows of the piezoelectric element rows.

The driver IC 500 mounted on the actuator substrate 20 is coupled to an individual electrode power supply wiring pattern 29 to which a driving waveform (driving signal) is supplied.

A wiring provided on the wiring member 60 is electrically coupled to the driver IC 500, and the other end side of the wiring member 60 is coupled to a controller on the apparatus main body side.

The actuator substrate 20 has the holding substrate 50 bonded to the diaphragm member 3 side of the actuator substrate 20 with an adhesive, and covering the piezoelectric element 11 on the actuator substrate 20.

The holding substrate 50 has: an opening 51 that is a part of a channel with which the common chamber 10 and the individual liquid chamber 6 side communicate with each other; a recess 52 that accommodates the piezoelectric element 11; and an opening 53 that accommodates the driver IC 500. The opening 51 is a slit-like through hole extending in the nozzle array direction, and is a part of the common chamber 10 here.

The holding substrate 50 is interposed between the actuator substrate 20 and the common chamber member 70 and is a part of the wall surface of the common chamber 10.

The common chamber member 70 forms the common chamber 10 that supplies liquid to each individual liquid chamber 6. The common chamber 10 is provided corresponding to each of the four nozzle rows, and liquid of a required color is supplied to the common chamber 10 from outside.

A damper member 90 is bonded to the common chamber member 70. The damper member 90 has a deformable damper 91 forming a wall surface of a part of the common chamber 10 and a damper plate 92 reinforcing the damper 91.

The common chamber member 70 is bonded to the outer peripheral portion of the nozzle plate 1 and the holding substrate 50 with an adhesive, and accommodates the actuator substrate 20 and the holding substrate 50 to form a frame of the liquid discharge head 404.

A cover member 45 is provided to cover the peripheral portion of the nozzle plate 1 and a part of the outer peripheral surface of the common chamber member 70.

In the liquid discharge head 404, a voltage is applied from the driver IC 500 to between the upper electrode 14 and the lower electrode 13 of the piezoelectric element 11, so that a piezoelectric layer 12 expands in an electrode stacking direction, that is, an electric field direction, and contracts in a direction parallel with the vibration region 30. As a result, a tensile stress is generated on the side of the lower electrode 13 of the vibration region 30, and the vibration region 30 bends toward the individual liquid chamber 6, and pressurizes the liquid inside, so that the liquid is discharged from the nozzle 4.

Figure 4:
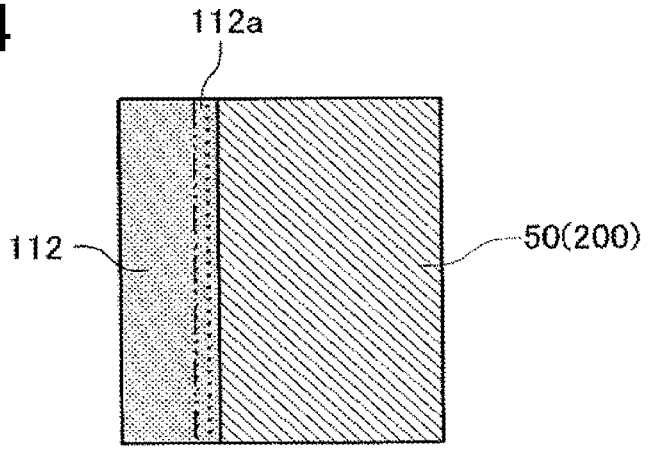
FIG. 4 is an enlarged cross-sectional explanatory view corresponding to A portion in FIG. 1 for explaining a surface treatment film in the first embodiment of the present disclosure.

Next, a surface treatment film according to the first embodiment of the present disclosure will be described with reference to FIGS. 4 and 5. FIG. 4 is an enlarged cross-sectional explanatory view corresponding to A portion of FIG. 1, and FIG. 5 is an enlarged cross-sectional explanatory view corresponding to B portion of FIG. 1.

In the present embodiment, channel formation members forming the channel of the liquid such as the nozzle plate 1, the channel plate 2, the diaphragm member 3, the holding substrate 50, and the like serve as a head substrate 200.

For example, as illustrated in FIG. 4, a surface treatment film 112 is on the wall surface of the opening 51 of the holding substrate 50. As illustrated in FIG. 5, the surface treatment film 112 is also formed on a channel wall surface such as a wall surface of the individual liquid chamber 6 of the channel plate 2 and on both surfaces of the nozzle plate 1. The surface treatment film 112 can also be formed on the wall surface of the nozzle 4.

Figure 5:
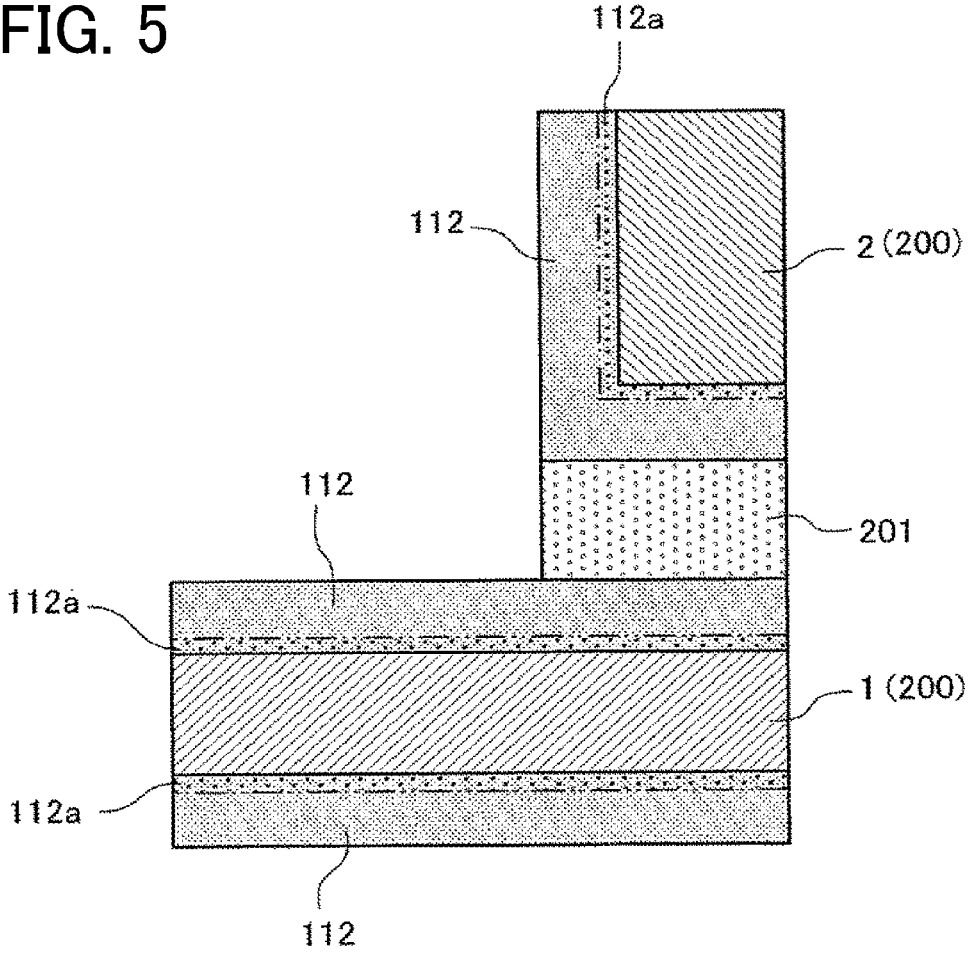
FIG. 5 is an enlarged cross-sectional explanatory view corresponding to B portion of FIG. 1.

As illustrated in FIG. 5, the nozzle plate 1 and the channel plate 2 are bonded by an adhesive 201.

Here, the surface treatment film 112 is an oxide film containing Si, and the oxide film contains a transition metal that forms a passive film.

The surface treatment film 112 is a composite oxide film of Si having high liquid resistance reliability and improving the adhesion between a transition metal species forming the passive film, and the adhesive 201.

Since being a thin film of an organic substance, the adhesive 201 transmits moisture. Therefore, when the surface treatment film 112 does not have liquid resistance reliability, the liquid corrodes the surface treatment film 112 via the adhesive 201 and peels off together with the adhesive 201.

However, since the transition metal species can form a stable oxide, a stable state can be maintained even in an aqueous solution, and the transition metal species can have resistance to liquid.

The oxide film containing Si has good compatibility with an anionic curing agent and a silane coupling agent contained in the adhesive 201, and improves the adhesion between the surface treatment film 112 and the adhesive 201.

As described above, the surface treatment film 112 is formed on the surface of the head substrate 200, the surface treatment film 112 is an oxide film containing Si, and the oxide film contains a transition metal forming a passive film. This makes it possible to achieve both improvement in adhesion at the interface between the surface treatment film 112 and the adhesive 201 and improvement in liquid resistance reliability.

That is, $SiO_2$ is contained, so that high adhesion with a member can be ensured. Also for adhesion with an adhesive, an amine type curing agent or a silane coupling agent is used, so that high water resistance can be ensured. The passive film is formed, and thereby, the surface treatment film 112 has a stable corrosion-resistant film on the surface, so that the surface treatment film is stable over a long term even when it comes in contact with liquid.

The transition metal can have a vacant orbit in an inner shell orbit such as a d-orbit or an f-orbit to have the plural oxidation number. Therefore, the surface treatment film 112 contains the transition metal species, so that the correspondence to the oxidation number of the whole film is increased. As a result, the allowable range for excess or deficiency of oxygen atoms is increased, and high stability for lost or excess of the oxygen number in the film is exhibited.

In the absence of a transition metal, defects of the surface treatment film 112 are caused due to excess or deficiency of oxygen atoms, and the defect is liable to cause dissolution due to a high energy state. On the other hand, in a case where a transition metal is contained, defects in the surface treatment film can be reduced, the stability of the oxide film is increased, and solubility in a liquid can be reduced.

Among such transition metals, when a metal that forms a passive film such as a valve metal is used, the solubility of the surface treatment film 112 can be further reduced.

As the metal forming the passive film, tantalum, niobium, titanium, hafnium, zirconium, or tungsten that is a transition metal having high correspondence to oxidation number is preferable.

Since tantalum, niobium, hafnium, or zirconium forms an extremely stable oxide film irrespective of whether the pH of the contacting liquid is acidic or alkaline, there is an advantage that the state can be maintained irrespective of acidity and alkalinity.

In other words, it is preferable that the surface treatment film 112 contains Group 4 and Group 5 transition metals forming a passive film. The Group 4 and Group 5 transition metals forming a passive film have an electron orbit similar to Si that is the Group 4 element, and when the transition metals are introduced into the $SiO_2$ film, Si and the metal species can be bonded strongly via O, the filling property of the film is improved, and a dense film can be formed.

In addition to improvement of the filling property, a strong bond is caused to exist in the surface treatment film 112 by the Si—O bond, so that it is possible to suppress the corrosion reaction upon contact with the liquid. As a result, an oxide film having resistance to liquid can be formed, sufficient resistance can be ensured, and the reliability of the liquid discharge head can be improved.

In this case, it is preferable that at least one of Hf, Ta, and Zr be contained as Group 4 and Group 5 transition metals forming a passive film.

At least one of Hf, Ta and Zr is introduced into the $SiO_2$ film, the transition metal species binds extremely strongly to O to form a passive film. At this time, in addition to improvement of the filling property of the film, a function of a passive film is caused to exist in the surface treatment film 112, so that it is possible to strongly suppress the corrosion reaction upon contact with the liquid of both acidic and alkaline. As a result, an oxide film resistant to acidic or alkaline liquid can be formed.

It is preferable that the surface treatment film 112 is completely oxidized. As a result, the crystal structure of the surface treatment film 112 becomes amorphous, and when the surface treatment film 112 is exposed to liquid, there are few crystal grain boundaries where corrosion is likely to occur and high resistance to liquid can be exhibited.

In the surface treatment film 112, it is preferable that the transition metal is contained in the film at 2 at % or more. As a result, the density of the surface treatment film 112 is reliably improved, and resistance to liquid is improved.

Next, an atomic layer deposition (ALD) method as a film formation method of the surface treatment film 112 will be described. In particular, when the head substrate serving as a base forming the surface treatment film 112 is formed of a material that is deformed by a heat treatment, it is preferable that the surface treatment film 112 is formed by the ALD method at 160° C. or less, especially 120° C. or less.

Since the ALD method completes the film forming reaction for each atomic layer, it is possible to form a film that is very dense and has fewer defects than the ordinary chemical vapor deposition (CVD) method or vapor deposition method. Since it is possible to form a film at a place where gas can be adsorbed to a member, a film can be uniformly formed on a member having a vertical wall or an edge portion.

It is preferable that the surface of the head substrate 200 in contact with the liquid other than the bonding surface is also coated with the surface treatment film 112. By such a configuration, components with low liquid resistance and adhesion improving materials to are hard to be eluted, so that a highly reliable structure can be provided.

When the surface treatment film 112 is formed on the surface of the diaphragm member 3 as the channel formation member, it is not preferable that the film is thick so as to affect the operation characteristics of a diaphragm member 3. Therefore, the surface treatment film 112 is at least 200 nm or less, preferably 50 nm or less.

Next, a film formation state of a surface treatment film by the ALD method will be described with reference to FIGS.

6A to 7B. FIGS. 6A to 7B are schematic explanatory diagrams for explaining the same.

Figure 6A:
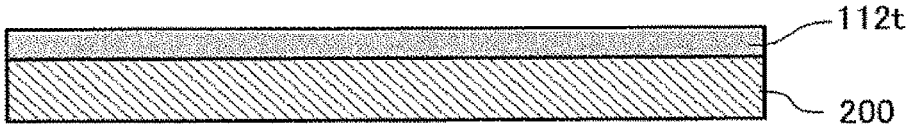
FIGS. 6A and 6B are schematic explanatory diagrams for explaining an ideal film formation state of a surface treatment film by the atomic layer deposition (ALD) method.
Figure 6B:
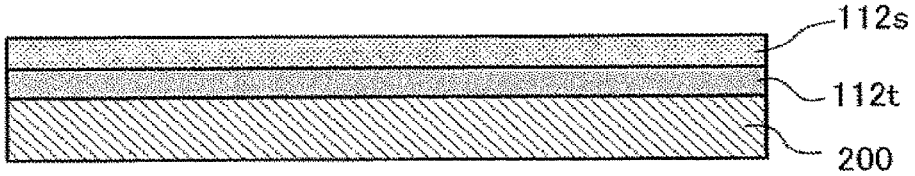

In the case of forming the surface treatment film 112 by the ALD method, it is possible to form a film digitally for each molecule by the ALD method. Therefore, as illustrated in FIG. 6A, a $Ta_2O_5$ film 112*t* is formed in the first cycle on the surface of the head substrate 200 made of a Si substrate, and as illustrated in FIG. 6B, in the case of forming a $SiO_2$ film 112*s* in the second cycle, it is ideal that the film is uniformly formed and stacked as a film for each molecular layer.

Figure 7A:
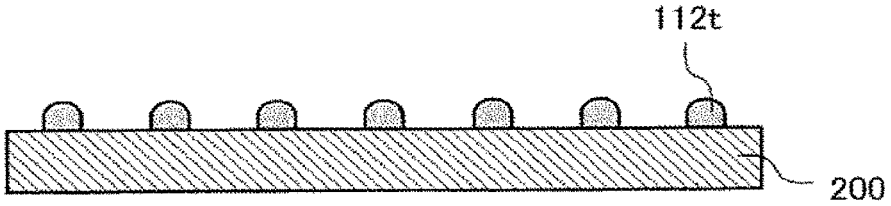
FIGS. 7A and 7B are schematic explanatory diagrams for explaining an actual film formation state of the surface treatment film by the ALD method.
Figure 7B:
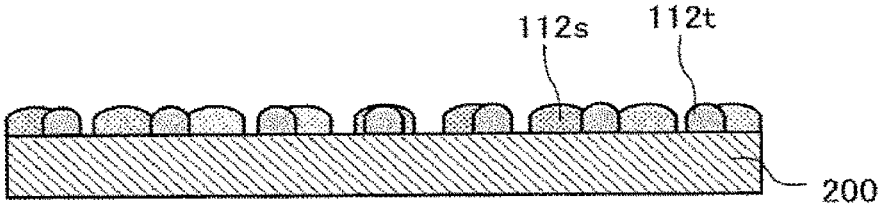

However, in practice, it has been found that the film is formed in an island shape instead of being uniform due to variations in surface energy and the like. That is, as illustrated in FIG. 7A, when a $Ta_2O_5$ film is formed in the first cycle on the surface of the head substrate 200, the $Ta_2O_5$ film is formed in an island shape, and as illustrated in FIG. 7B, when the $SiO_2$ film is formed in the second cycle, the $SiO_2$ film is also formed in an island shape, and a portion entering between the $Ta_2O_5$ films in the first cycle is generated.

Therefore, the surface treatment film 112 is in a state in which the $Ta_2O_5$ film 112*t* and the $SiO_2$ film 112*s* formed in an island shape coexist at the interface with the head substrate 200.

Here, the adhesion (adhesion strength) of the surface treatment film 112 to the head substrate 200 depends on the contact area ratio between the $Ta_2O_5$ film and the $SiO_2$ film at the interface between the surface treatment film 112 and the head substrate 200.

Therefore, the relationship between the occupied area ratio of the $SiO_2$ film at the interface between the head substrate 200 and the surface treatment film 112 and the adhesion (adhesion strength) at the interface between the head substrate 200 and the surface treatment film 112 will be described with reference to FIGS. 8 and 9. FIG. 8 is an explanatory chart illustrating numerical values of an example of the relationship, and FIG. 9 is an explanatory graph of FIG. 8.

Figure 9:
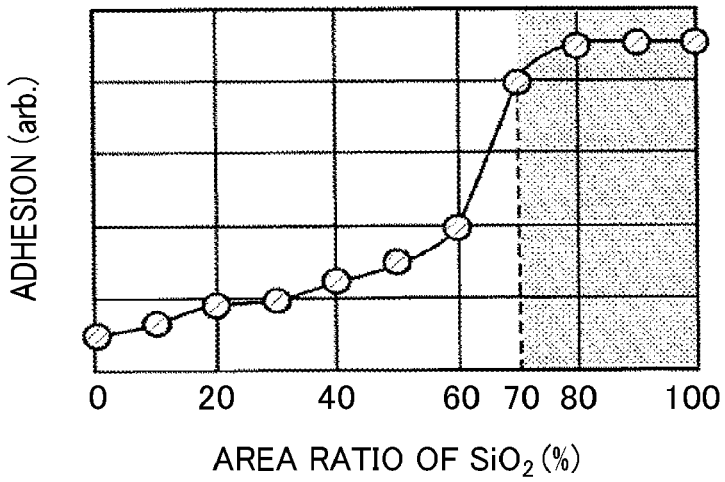
FIG. 9 is an explanatory graph of FIG. 8.

As seen from FIGS. 8 and 9, the adhesion of the surface treatment film 112 to the head substrate 200 depends on the contact area ratio between the $Ta_2O_5$ film and the $SiO_2$ film at the interface between the surface treatment film 112 and the head substrate 200. When the occupied area ratio of the $SiO_2$ film at the interface between the surface treatment film 112 and the head substrate 200 is 70% or more, the adhesion significantly increases.

Figure 10A:
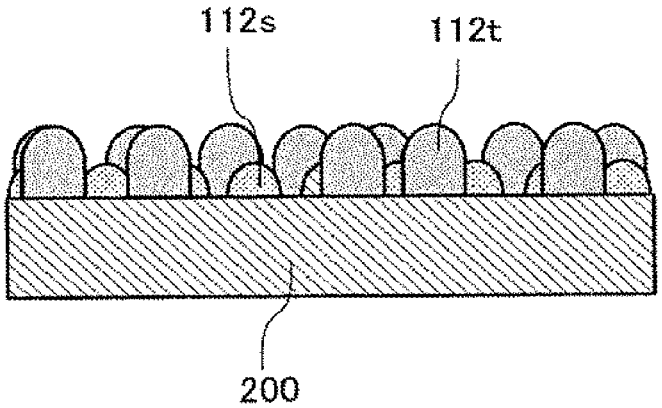
FIGS. 10A and 10B are explanatory diagrams illustrating a model of a difference in the occupied area ratio of the $SiO_2$ film at the interface between the surface treatment film and the head substrate.
Figure 10B:
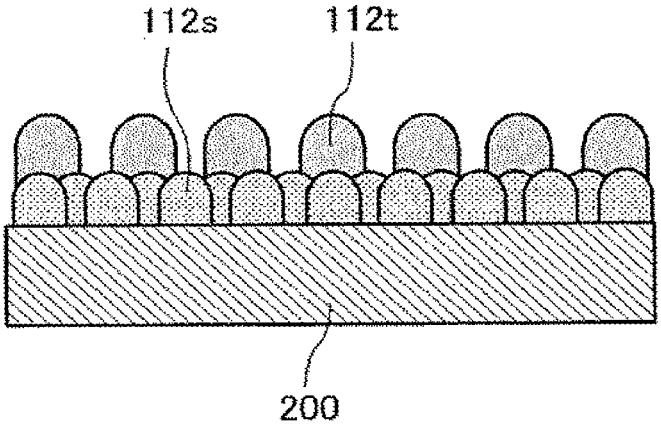
Figure 11:
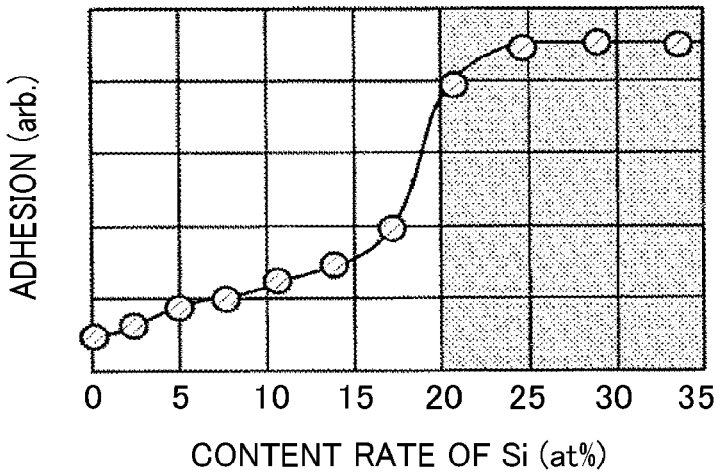
FIG. 11 is an explanatory graph of the relationship between the content of a contained element Si and the adhesion strength in FIG. 8.

Next, the relationship between the occupied area ratio of the $SiO_2$ film at the interface between the surface treatment film 112 and the head substrate 200, the content ratio of Si, and the adhesion will be described with reference to FIGS. 10A to 11. FIGS. 10A and 10B are explanatory diagrams illustrating a model of a difference in the occupied area ratio of the $SiO_2$ film at the interface between the surface treatment film 112 and the head substrate 200. FIG. 11 is an explanatory graph of the relationship between the content of a contained element Si and the adhesion strength in FIG. 8.

As illustrated in FIG. 10A, when the occupied area ratio of the $SiO_2$ film 112*s* of the surface treatment film 112 is low at the interface between the surface treatment film 112 and the head substrate 200, the Si content at the interface decreases. On the other hand, as illustrated in FIG. 10B, when the occupied area ratio of the $SiO_2$ film 112*s* of the surface treatment film 112 is high at the interface between the surface treatment film 112 and the head substrate 200, the Si content at the interface increases.

The "content" is a value indicating the substance amount (mol) of Si relative to the substance amount of the sum of the substance amount of Si (mol), the substance amount of Ta (mol), and the substance amount of O (mol) as a percentage. The "occupied area ratio" is a value indicating the occupied area of $SiO_2$ as a percentage relative to the sum of the occupied area of $SiO_2$ and the occupied area of $Ta_2O_5$ in the vicinity of the interface between the surface treatment film and the head substrate.

Since the adhesion of $SiO_2$ to the head substrate 200 made of the Si substrate is higher than that of $Ta_2O_5$, as illustrated in FIG. 11, the Si content of the surface treatment film 112 at the interface with the head substrate 200 is increased, so that the adhesion is improved.

More specifically, referring to FIG. 11, until the Si content of the surface treatment film 112 at the interface with the head substrate 200 reaches about 20 at %, the adhesion is relatively low. However, when the content is 20 at % or more, the adhesion becomes high, and in particular, when the content is 25 at % or more, the adhesion is stabilized to high.

The content of Ta in the surface treatment film 112 at the interface with the head substrate 200 is preferably 10 at % or less.

Here, when the Si content is about 33 at %, only $SiO_2$ is in contact with the surface of the head substrate 200 ($SiO_2$ is 100%).

Therefore, referring to FIGS. 4 and 5, the Si content in the surface treatment film 112 in an interface vicinity region 112*a* with the head substrate 200 is set to be 20% or more, so that adhesion of the surface treatment film 112 to the head substrate 200 improves, and it is possible to prevent the surface treatment film 112 from peeling from the head substrate 200.

On the other hand, the surface treatment film 112 requires the liquid resistance, so that the content of Si in the inside of the surface treatment film 112 is made smaller than the content (20 at % or more) in the interface vicinity region 112*a*. For example, the content of Si in the inside of the surface treatment film 112 is preferably in the range of about 10 to 15 at %. The content of Ta in the inside of the surface treatment film 112 is preferably 15 at % or more.

Here, in order to change the Si content of the surface treatment film 112 by the ALD method, normally, after a step of forming a $SiO_2$ film, a step of forming a $Ta_2O_5$ film is performed, and each film is alternately formed one step at a time. In the case of increasing the Si content, film formation of the $SiO_2$ film may be successively performed in a plurality of steps.

The Si content can be adjusted by changing the number of steps.

It is preferable that the region (interface vicinity region 112*a*) of the surface treatment film 112 in which the Si content is higher than the inside is set to be within the thickness range of 1 to 10 nm from the interface with the head substrate 200 because of the internal liquid resistance. In order to achieve both prevention of peeling and securing of liquid resistance of the surface treatment film 112, the Si content in the thickness range of about 5 nm (3 to 7 nm) from the interface with the head substrate 200 is preferably higher than the inside, and more preferably 20 at % or more.

In this way, the Si content is changed in the thickness direction of the surface treatment film 112, so that the ratio of Si in the surface treatment film 112 in the vicinity of the interface with the head substrate 200 is higher than that in the inside of the surface treatment film 112, and is 20 at % or more.

As a result, the adhesion with the head substrate 200 can be improved, peeling from the head substrate 200 can be prevented, and liquid resistance can also be improved.

Here, an example is described where the transition metal forming the passivation film included in the surface treatment film 112 is Ta. However, similar action and effect to those of the above embodiment can be obtained with a surface treatment film containing as the transition metal forming the passive film, Zr, other Group 4 or Group 5 transition metal.

Figure 12:
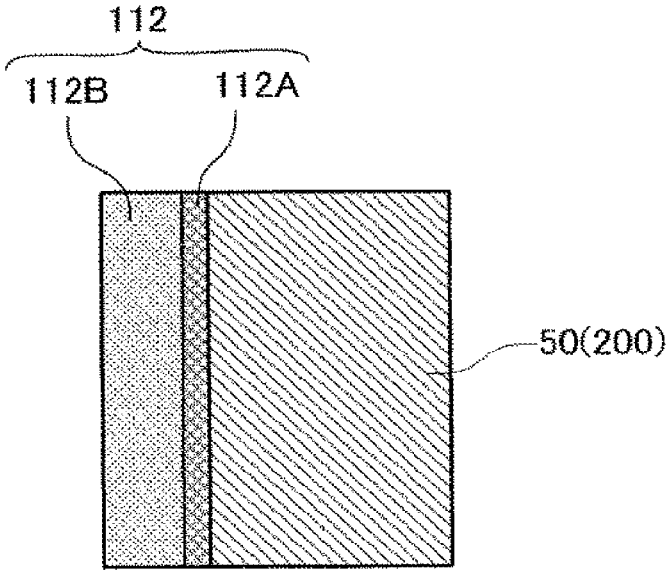
FIG. 12 is an enlarged cross-sectional explanatory view corresponding to the A portion in FIG. 1 similar to FIG. 4 for explaining a second embodiment of the present disclosure.
Figure 13:
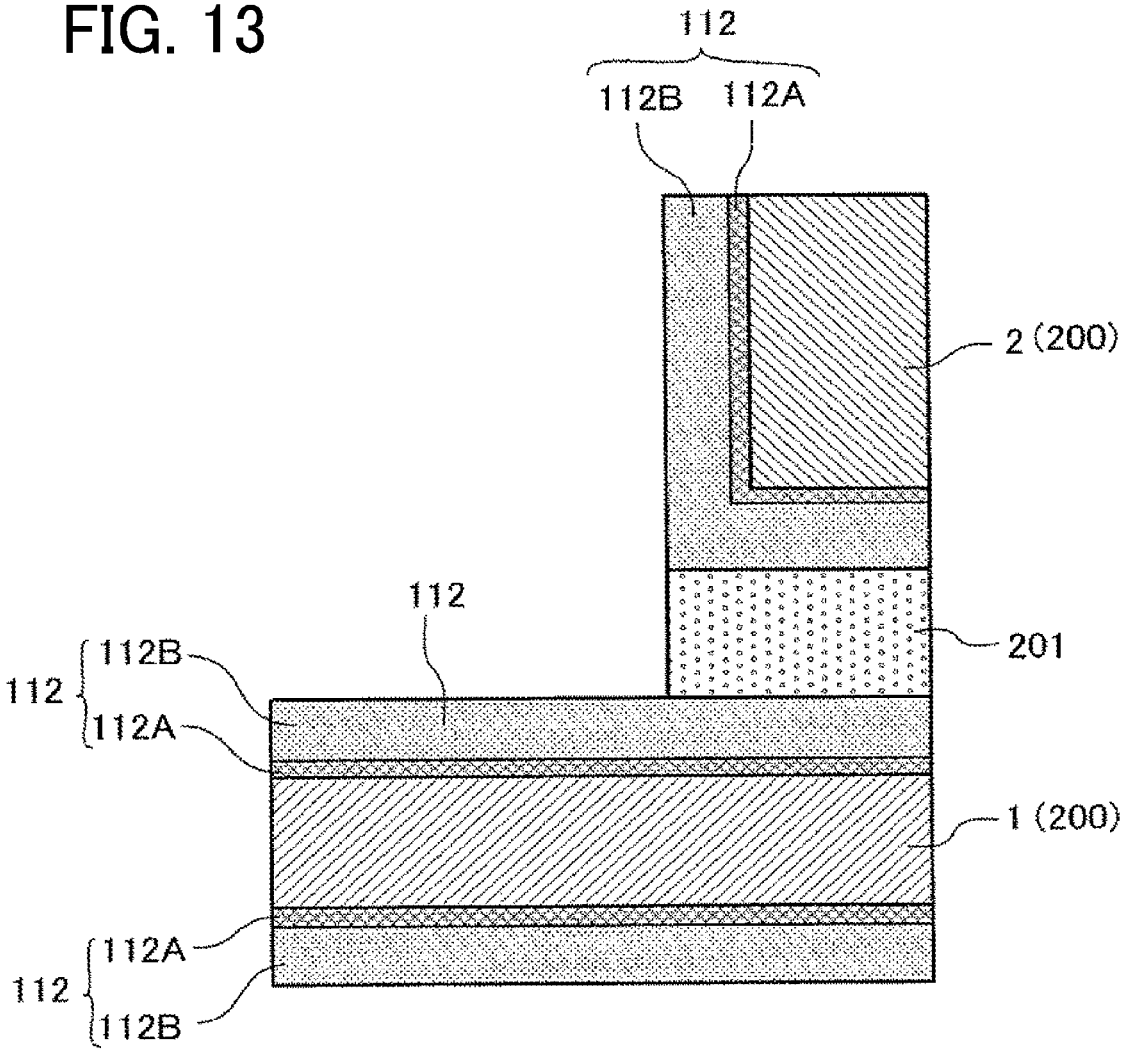
FIG. 13 is an enlarged cross-sectional explanatory view corresponding to the B portion of FIG. 1 similar to FIG. 5.

Next, a surface treatment film according to a second embodiment of the present disclosure will be described with reference to FIGS. 12 and 13. FIG. 12 is an enlarged cross-sectional explanatory view corresponding to the A portion of FIG. 1 similar to FIG. 4, and FIG. 13 is an enlarged cross-sectional explanatory view corresponding to the B portion of FIG. 1 similar to FIG. 5.

The surface treatment film 112 has a layer 112A in the vicinity of the interface with the head substrate 200, the layer 112A having a Si content higher than the Si content of the inside of the surface treatment film 112 and is 20 at % or more. A region including the inside of the surface treatment film 112 other than the layer 112A having high Si content is used as a layer 112B having a Si content of, for example, 7 to 20 at % in order to improve the liquid resistance.

As a result, it is possible to obtain similar action and effect as those of the first embodiment.

Figure 14:
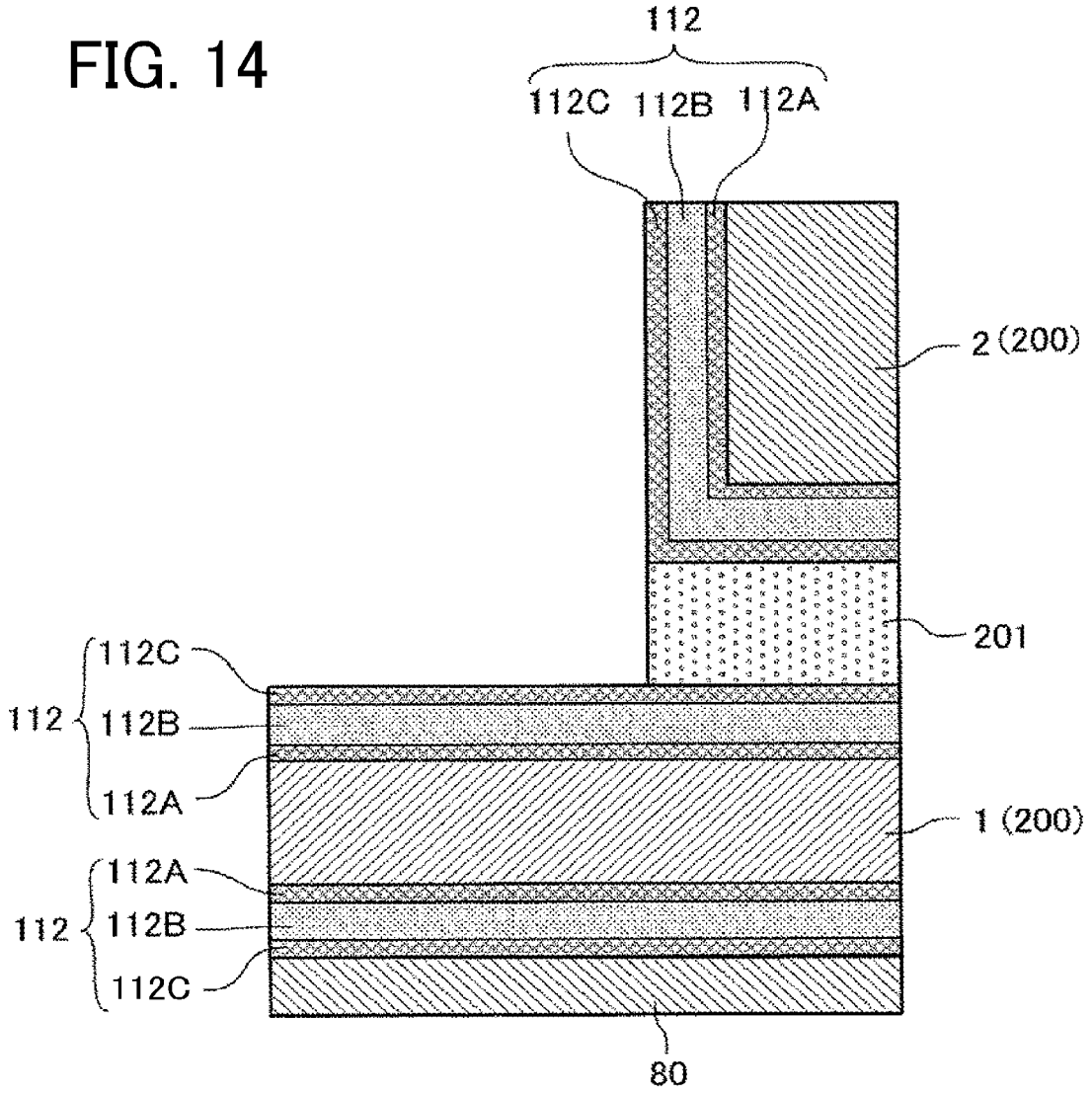
FIG. 14 is an enlarged cross-sectional explanatory view corresponding to the B portion of FIG. 1 similar to FIG. 5 for explaining a third embodiment of the present disclosure.

Next, a surface treatment film according to a third embodiment of the present disclosure will be described with reference to FIG. 14. FIG. 14 is an enlarged cross-sectional explanatory view corresponding to the B portion of FIG. 1 similar to FIG. 5.

The surface treatment film 112 has a layer 112C in the opposite surface from the interface with the head substrate 200, the layer 112C having a Si content higher than the Si content of the inside of the surface treatment film 112 and is 20 at % or more.

That is, the layers 112A and 112C having a Si content higher than the Si content of the inside are formed on both surfaces of the surface treatment film 112, and a region including the inside of the surface treatment film 112 other than the layers 112A and 112C is the layer 112B having a Si content of, for example, 7 to 20 at % in order to improve the liquid resistance.

In this case, the surface treatment film 112 is also in contact with the adhesive 201 for bonding the channel plate 2 and the nozzle plate 1, and the adhesion between the surface treatment film 112 and the adhesive 201 also affects the head quality. Likewise, the actuator substrate 20 and the holding substrate 50 are also bonded with an adhesive, and the adhesion in this portion between the surface treatment film 112 and the adhesive also affects the head quality.

The surface treatment film 112 is formed on a discharge face 1*a* side of the nozzle plate 1, a liquid repellent film 80 is formed on the surface of the surface treatment film 112, and the adhesion between the surface treatment film 112 and the liquid repellent film 80 needs to be secured. Also in the adhesion between the surface treatment film 112 and the liquid repellent film 80, siloxane bond (O—Si—O bond) has the highest adhesion.

Therefore, the layers 112A and 112C having a Si content higher than the Si content of the inside are formed on both surfaces of the surface treatment film 112, so that the adhesion between the surface treatment film 112 and the adhesive 201, or between the surface treatment film 112 and the liquid repellent film 80 can also be improved.

Note that the thicknesses of the layers 112A and 112C in which the Si content is 20 at % or more may be the same or different.

Figure 15:
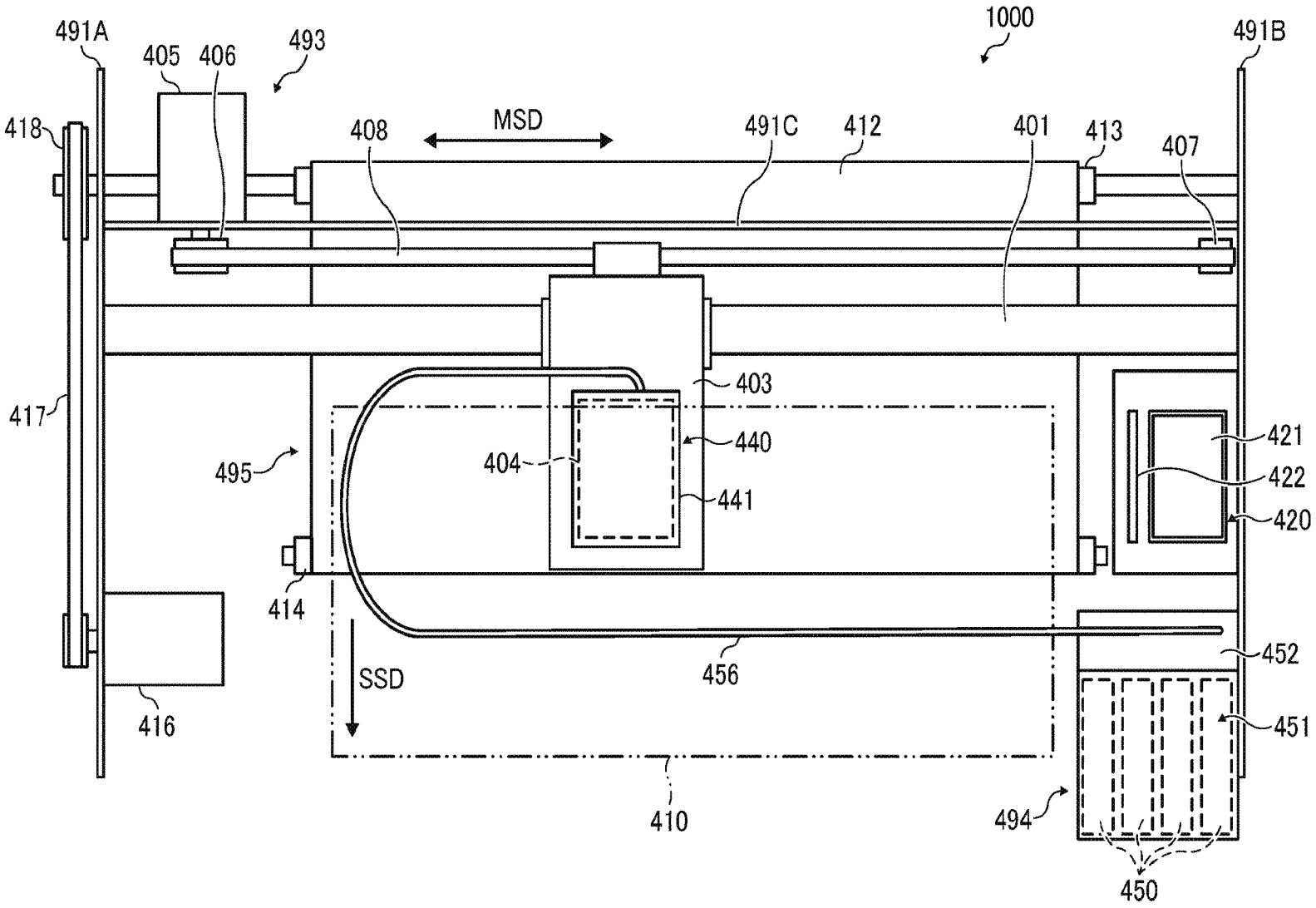
FIG. 15 is an explanatory plan view of a main portion of an example of a liquid discharge apparatus according to an embodiment of the present disclosure.
Figure 16:
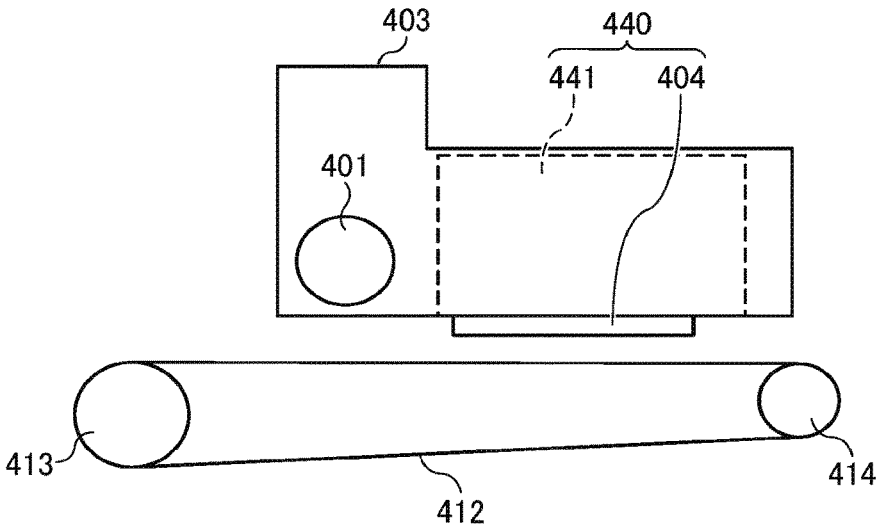
FIG. 16 is an explanatory side view of a main portion of the liquid discharge apparatus.

Next, a liquid discharge apparatus according to an embodiment of the present disclosure will be described with reference to FIGS. 15 and 16. FIG. 15 is an explanatory plan view of a main portion of the liquid discharge apparatus. FIG. 16 is an explanatory side view of a main portion of the liquid discharge apparatus.

The liquid discharge apparatus 1000 according to the present embodiment is a serial type apparatus, and a carriage 403 reciprocates in a main-scanning direction indicated by arrow MSD in FIG. 15 with a main scanning movement mechanism 493. The main scanning movement mechanism 493 includes a guide member 401, a main scanning motor 405, a timing belt 408, and the like. The guide member 401 is bridged between left and right side plates 491A and 491B so as to movably hold the carriage 403. The carriage 403 reciprocates in the main-scanning direction by the main scanning motor 405 via the timing belt 408 bridged between a driving pulley 406 and a driven pulley 407.

The carriage 403 is mounted with a liquid discharge device 440 in which a liquid discharge head 404 and a head tank 441 are integrated according to the present disclosure. The liquid discharge head 404 of the liquid discharge device 440 discharges liquid of each color, for example, yellow (Y), cyan (C), magenta (M), and black (K). The liquid discharge head 404 has a nozzle row including a plurality of nozzles and arranged in a sub-scanning direction indicated by arrow SSD in FIG. 15 orthogonal to the main-scanning direction, and is mounted so that the discharge direction faces downward.

A supply mechanism 494 is for supplying liquid stored in the outside of the liquid discharge head 404 to the liquid discharge head 404. The supply mechanism 494 supplies liquid stored in a liquid cartridge 450 to the head tank 441.

The supply mechanism 494 includes: a cartridge holder 451 that is a filling unit mounted with the liquid cartridge 450; a tube 456; a liquid transfer unit 452 including a liquid transfer pump; and the like. The liquid cartridge 450 is detachably mounted to the cartridge holder 451. The liquid transfer unit 452 sends liquid from the liquid cartridge 450 to the head tank 441 via the tube 456.

This apparatus includes a conveying mechanism 495 that conveys paper 410. The conveying mechanism 495 includes a conveying belt 412 as a conveying means and a sub-scanning motor 416 for driving the conveying belt 412.

The conveying belt 412 attracts the paper 410 and conveys the paper 410 at a position facing the liquid discharge head 404. The conveying belt 412 is an endless belt, and is bridged between a conveying roller 413 and a tension roller 414. The attraction can be performed by electrostatic attraction, air attraction, or the like.

The conveying belt 412 circulates in the sub-scanning direction by rotation of the conveying roller 413 via a timing belt 417 and a timing pulley 418 by the sub-scanning motor 416.

On one side of the carriage 403 in the main-scanning direction, a maintenance and recovery mechanism 420 for maintaining and recovering the liquid discharge head 404 is arranged on the side of the conveying belt 412.

The maintenance and recovery mechanism 420 includes, for example, a cap member 421 that caps the nozzle surface (surface on which a nozzle is formed) of the liquid discharge head 404, a wiper member 422 that wipes the nozzle surface, and the like.

The main scanning movement mechanism 493, the supply mechanism 494, the maintenance and recovery mechanism 420, and the conveying mechanism 495 are attached to a housing including the side plates 491A and 491B and a back plate 491C.

In this apparatus configured as described above, the paper 410 is fed and attracted onto the conveying belt 412, and the paper 410 is conveyed in the sub-scanning direction by circulation of the conveying belt 412.

Therefore, the liquid discharge head 404 is driven according to an image signal while the carriage 403 is moved in the main-scanning direction, so that the liquid is discharged onto the paper 410 that is stopping to form an image.

In this way, since this apparatus includes the liquid discharge head according to the present embodiment, high-quality images can be stably formed.

Figure 17:
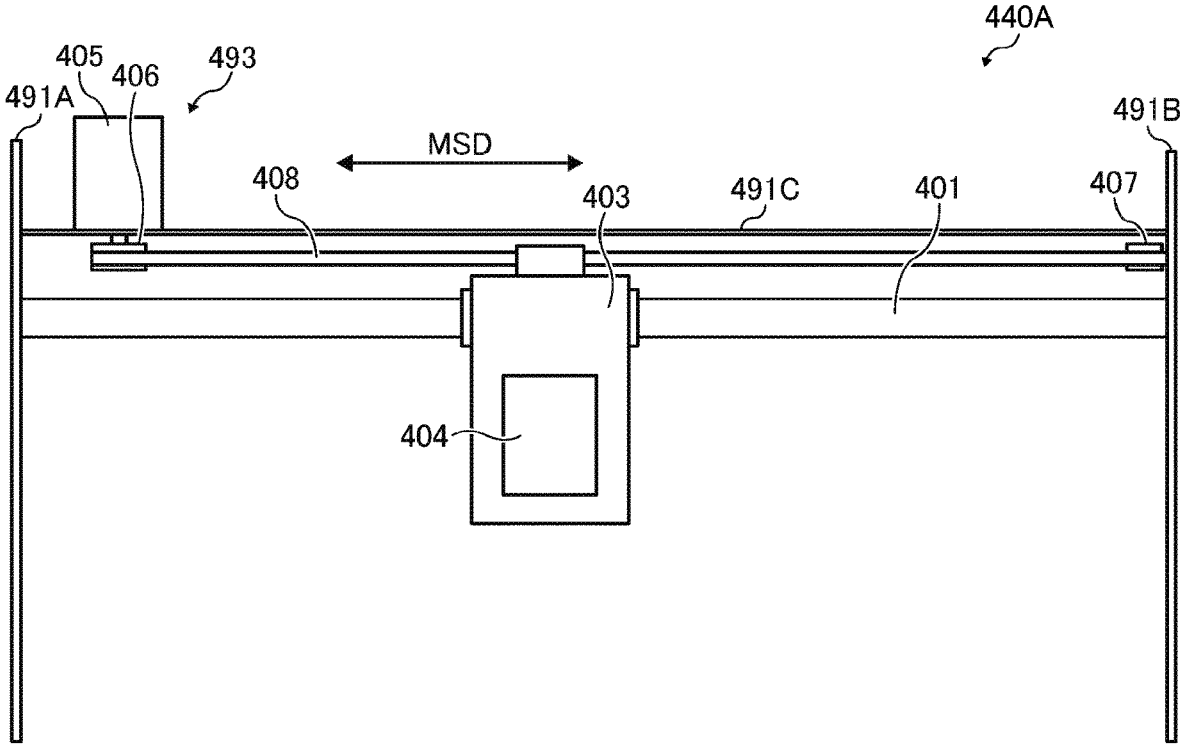
FIG. 17 is an explanatory plan view of a main portion of another example of a liquid discharge device according to an embodiment of the present disclosure.

Next, the liquid discharge device according to another embodiment of the present disclosure will be described with reference to FIG. 17. FIG. 17 is an explanatory plan view of a main portion of the liquid discharge device.

The liquid discharge device 440A according to the present embodiment includes: among members included in the liquid discharge apparatus 1000, a casing including the side plates 491A and 491B, and the back plate 491C; the main scanning movement mechanism 493; the carriage 403; and the liquid discharge head 404.

Note that the liquid discharge device 440A may further include at least one of the maintenance and recovery mechanism 420 and the supply mechanism 494 in, for example, the side plate 491B of the liquid discharge device 440A.

Figure 18:
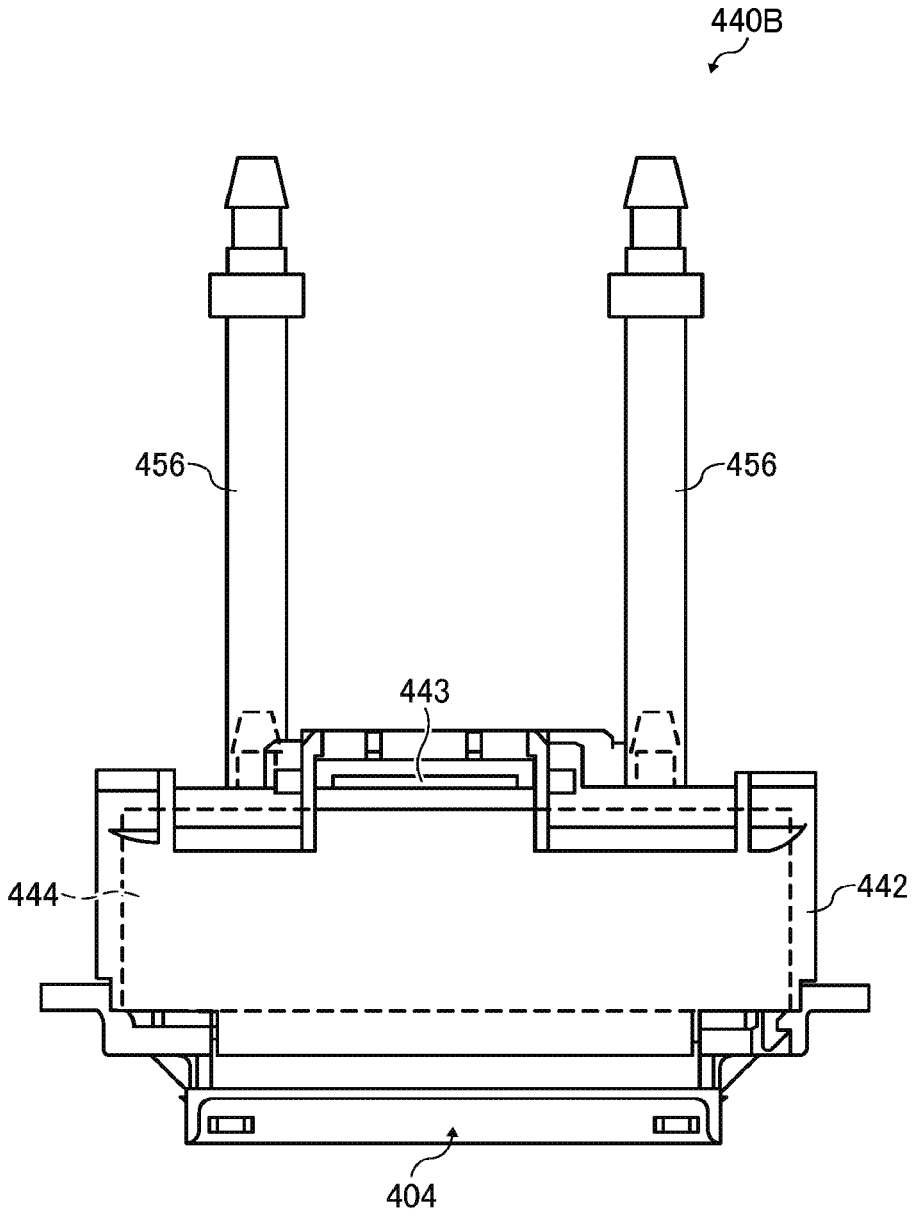
FIG. 18 is an explanatory front view of still another example of the liquid discharge device according to an embodiment of the present disclosure.

Next, the liquid discharge device according to still another embodiment of the present disclosure will be described with reference to FIG. 18. FIG. 18 is an explanatory front view of the liquid discharge device.

The liquid discharge device 440B according to the present embodiment includes the liquid discharge head 404 to which a channel component 444 that is a liquid supply member is attached, and a tube 456 coupled to the channel component 444.

Note that the channel component 444 is arranged inside a cover 442. Instead of the channel component 444, a head tank 441 can be included. The channel component 444 has a connector 443 that electrically couples with the liquid discharge head 404 on the upper part of the channel component 444.

In the present application, the discharged liquid may be any liquid having viscosity and surface tension with which discharge can be performed from the head, and is not particularly limited. However, it is preferable that the liquid has viscosity of 30 mPa·s or less at ordinary temperature and ordinary pressure or by heating and cooling. More specifically, the liquid is solution, suspension, emulsion, or the like including a solvent such as water or an organic solvent, a colorant such as a dye or a pigment, a functionalizing material such as a polymerizable compound, a resin or a surfactant, a biocompatible material such as DNA, amino acid, protein, or calcium, an edible material such as a natural pigment, and the like, which can be used, for example, as formation liquid of an inkjet ink, a surface treatment liquid, constituent elements of an electronic element or a light-emitting element, and an electronic circuit resist pattern, three-dimensional modeling material solution, or the like.

Examples of an energy generation source that discharges liquid include one that uses a thermal actuator using an electrothermal transducer such as a piezoelectric actuator (laminated type piezoelectric element and thin film type piezoelectric element), or a heating resistor, an electrostatic actuator including a diaphragm and a counter electrode, and the like.

The "liquid discharge device" is a liquid discharge head integrated with functional parts and mechanisms, and includes a group of components related to discharge of liquid. Examples of the "liquid discharge device" include a liquid discharge head combined with at least one of a head tank, a carriage, a supply mechanism, a maintenance and recovery mechanism, and a main scanning movement mechanism.

Here, integration means, for example, one in which the liquid discharge head, the functional parts, and the mechanism are secured to each other by fastening, adhesion, engagement, or the like, and one in which one is held movably with respect to the other. The liquid discharge head, the functional parts, and the mechanism may be configured to be detachable from each other.

For example, there is a liquid discharge device in which a liquid discharge head and a head tank are integrated. In addition, there is liquid discharge device in which a liquid discharge head and a head tank are coupled to each other by a tube or the like so as to be integrated with each other. Here, a unit including a filter may be added between the head tank of these liquid discharge device and liquid discharge head.

There is a liquid discharge device in which a liquid discharge head and a carriage are integrated.

There is a liquid discharge device in which a liquid discharge head is movably held on a guide member forming a part of the scanning movement mechanism, and the liquid discharge head and the scanning movement mechanism are integrated. There is a liquid discharge device in which a liquid discharge head, a carriage, and a main scanning movement mechanism are integrated.

There is a liquid discharge device in which a cap member, which is a part of a maintenance and recovery mechanism, is secured to a carriage to which a liquid discharge head is attached, so that the liquid discharge head, the carriage, and the maintenance and recovery mechanism are integrated.

There is a liquid discharge device in which a tube is coupled to a liquid discharge head to which a head tank or a channel component is attached, and the liquid discharge head and the supply mechanism are integrated. Through this tube, the liquid of the liquid storage source is supplied to the liquid discharge head.

The main scanning movement mechanism also includes a single guide member. The supply mechanism also includes a single tube and a single filling unit.

Examples of the "liquid discharge apparatus" include an apparatus that includes a liquid discharge head or a liquid discharge device, and drives the liquid discharge head to discharge liquid. Examples of the liquid discharge apparatus include not only an apparatus that can discharge liquid to a liquid adherable material but also an apparatus that discharges liquid towards air or liquid.

This "liquid discharge apparatus" may include a means related to feeding of a liquid adherable material, conveying, and sheet ejection, a preprocessing device, a post-processing device, or the like.

For example, as a "liquid discharge apparatus", there are an image forming apparatus that is an apparatus that discharges ink to form an image on paper, and a stereoscopic modeling apparatus (three-dimensional modeling apparatus) that discharges modeling liquid onto a powder layer in which powder materials are formed in a layered shape in order to mold a stereoscopic modeling apparatus (three-dimensional modeling apparatus).

The "liquid discharge apparatus" is not limited to one with which significant images such as letters, graphics, or the like is visualized by discharged liquid. For example, one that forms a pattern or the like that itself has no meaning, and one that molds a three-dimensional image are included.

The above-mentioned "liquid adherable material" means one to which liquid can be adhered at least temporarily, adhered and fastened, adhered and permeated, or the like. Specific examples include a recording medium such as paper, a recording sheet, recording paper, a film, or a cloth, an electronic component such as an electronic substrate or a piezoelectric element, and a medium such as a powder material layer (powder layer), organ model, or an inspection cell, and unless specifically limited, include everything to which liquid adheres.

The material of above-mentioned "liquid adherable material" may be any material such as paper, thread, fiber, cloth, leather, metal, plastic, glass, wood, ceramics or the like as long as liquid can adhere to the material even temporarily.

As the "liquid discharge apparatus", there is an apparatus in which a liquid discharge head and a liquid adherable material move relative to each other, but this is not a limitation. Specific examples include a serial type apparatus that moves the liquid discharge head, a line type apparatus that does not move the liquid discharge head, or the like.

As a "liquid discharge apparatus", there are also a treatment liquid application apparatus that discharges treatment liquid onto paper in order to apply the treatment liquid to the surface of the sheet for the purpose of modifying the surface of the paper or the like, an injection granulation apparatus that granulates fine particles of a raw material by injecting a composition liquid in which raw materials are dispersed in a solution, through a nozzle, and the like.

In the terms of the present application, image formation, recording, typing, imaging, printing, molding and the like are all synonymous.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge head comprising:
a head substrate; and
a surface treatment film on a surface of the head substrate,
wherein the surface treatment film comprises silicon oxide and an oxide of a transition metal which forms a passive film,
wherein a content of Si in a vicinity of an interface of the surface treatment film with the head substrate is higher than a content of Si in an inside of the surface treatment film and is 20 at % or more.

2. The liquid discharge head according to claim 1,
wherein a content of the transition metal in the inside of the surface treatment film is 15 at % or more.

3. The liquid discharge head according to claim 1,
wherein a content of Si in a surface of the surface treatment film opposite to the interface of the surface treatment film with the head substrate is higher than the content of Si in the inside of the surface treatment film and is 20 at % or more.

4. The liquid discharge head according to claim 1,
wherein a thickness of a region having the content of Si higher than the content of Si in the inside of the surface treatment film is in a range of 1 to 10 nm.

5. The liquid discharge head according to claim 1,
wherein the surface treatment film comprises at least one transition metal selected from Group 4 or 5.

6. The liquid discharge head according to claim 1,
wherein the head substrate is a channel formation member to form a channel of liquid.

7. The liquid discharge head according to claim 6,
wherein the channel formation member is bonded to another head substrate with an adhesive.

8. The liquid discharge head according to claim 1,
wherein the head substrate is a nozzle plate that discharges liquid,
wherein the surface treatment film is formed on a discharge surface of the nozzle plate, and
wherein a liquid repellent film is formed on a surface of the surface treatment film.

9. A liquid discharge device comprising the liquid discharge head according to claim 1.

10. The liquid discharge device according to claim 9,
wherein the liquid discharge head is integrated with at least one of:
a head tank to store liquid to be supplied to the liquid discharge head;
a carriage on which the liquid discharge head is mounted;
a supply mechanism to supply the liquid to the liquid discharge head;
a maintenance and recovery mechanism to perform maintenance and recovery of the liquid discharge head; and
a main scanning movement mechanism to move the liquid discharge head in a main-scanning direction.

11. A liquid discharge apparatus comprising the liquid discharge device according to claim 9.

12. A liquid discharge apparatus comprising the liquid discharge head according to claim 1.

13. A liquid discharge head comprising:
a head substrate; and
a surface treatment film on a surface of the head substrate,
wherein the surface treatment film is an oxide film comprising Si,
wherein the oxide film comprises a transition metal to form a passive film,
wherein a content of Si in a vicinity of an interface of the surface treatment film with the head substrate is higher than a content of Si in an inside of the surface treatment film and is 20 at % or more, and
wherein a content of the transition metal in the vicinity of the interface of the surface treatment film with the head substrate is 10 at % or less.

14. The liquid discharge head according to claim 13,
wherein a content of the transition metal in the inside of the surface treatment film is 15 at % or more.

15. The liquid discharge head according to claim 13,
wherein a content of Si in a surface of the surface treatment film opposite to the interface of the surface treatment film with the head substrate is higher than the content of Si in the inside of the surface treatment film and is 20 at % or more.

16. The liquid discharge head according to claim 13,
wherein a thickness of a region having the content of Si higher than the content of Si in the inside of the surface treatment film is in a range of 1 to 10 nm.

17. A liquid discharge head comprising:
a head substrate; and a surface treatment film on a surface of the head substrate, wherein the surface treatment film is an oxide film comprising Si, wherein the oxide film comprises a transition metal to form a passive film, wherein a content of Si in a vicinity of an interface of the surface treatment film with the head substrate is higher than a content of Si in an inside of the surface treatment film and is 20 at % or more, and wherein the content of Si in the inside of the surface treatment film is 10 to 15 at % or less.

18. The liquid discharge head according to claim 17, wherein a content of the transition metal in the inside of the surface treatment film is 15 at % or more.

19. The liquid discharge head according to claim 17, wherein a content of Si in a surface of the surface treatment film opposite to the interface of the surface treatment film with the head substrate is higher than the content of Si in the inside of the surface treatment film and is 20 at % or more.

20. The liquid discharge head according to claim 17, wherein a thickness of a region having the content of Si higher than the content of Si in the inside of the surface treatment film is in a range of 1 to 10 nm.

* * * * *